United States Patent [19]

Markert

[11] 4,033,088

[45] July 5, 1977

[54] METHOD OF AND APPARATUS FOR PACKAGING POULTRY SPECIMENS

[75] Inventor: Georg H. Markert, Bennekom, Netherlands

[73] Assignee: Maschinefabriek Markert B.V., Ede, Netherlands

[22] Filed: Nov. 11, 1975

[21] Appl. No.: 631,135

[52] U.S. Cl. ..... 53/29; 53/189

[51] Int. Cl.[2] ..... B65B 5/04; B65B 25/00; B65B 39/02

[58] Field of Search ..... 53/189, 258, 260, 261, 53/29

[56] References Cited

UNITED STATES PATENTS

| | | | |
|---|---|---|---|
| 3,868,807 | 3/1975 | Noyes et al. | 53/29 |
| 3,971,191 | 7/1976 | Hoyland | 53/189 X |

*Primary Examiner*—Robert Louis Spruill
*Attorney, Agent, or Firm*—Walter Becker

[57] ABSTRACT

A method of and apparatus for packaging poultry specimens in bags, according to which each specimen is grasped by the legs, advanced on a support with the legs engaging the body of the specimen into a bag, whereupon the support is withdrawn and the bag with the poultry specimen is conveyed to a treatment station for further treatment.

5 Claims, 5 Drawing Figures

METHOD OF AND APPARATUS FOR PACKAGING POULTRY SPECIMENS

The present invention relates to a method of packaging specimens of prepared poultry in bags, each specimen being so placed in a bag that the legs are lifted and come to lien against the bottom side of the body, whereafter the bag with contents is discharged for further treatment. Hitherto people had not succeeded to effect the manual packaging of poultry mechanically, at least in an economically justified manner, which partly resulted from the difficult handling of the shape of the poultry body, offering little catching possibilities. This applies in particular to the legs, which have to lie in the bag in a position tightly folded against the body.

It is an object of the invention to provide a method by which the above drawback is overcome such that there is obtained a sufficiently rapid and reliable packaging method.

To this effect, of the method according to the invention, each specimen to be packaged is engaged at the legs by means of catching means advanced by a conveyor belt and there is produced, through pushing means acting on the legs, an upward pushing motion in the direction of the poultry body, following by a translation, through said pushing motion in the same direction of the specimen across an articulated funnel provided with stop means, said funnel having jaws movable relative to each other. Said jaws are inserted, in converged position in a bag maintained stationary by retaining means, whereafter the jaws move outwardly relative to each other so that the poultry specimen can leave the funnel via the jaws arriving in the bag enveloping the funnel; thereupon the funnel is retracted and the bag containing the poultry specimen is advanced by the pushing means in such a way that, through coaction of the pushing means and bag retaining means, at least the filled bag portion is released from the retaining means.

In a preferred embodiment the poultry specimens are supplied to the catching means by catching a conveyor belt, the path of which intersects the path of said catching means perpendicularly; on this belt there are disposed receptor trays in adjacent relationship. The trays are adapted to receive the poultry specimens one after the other. Each leg is held in a resilient clamp adapted to be opened against the action of the resiliency means of the resilient clamp when the catching means engage the legs and the pushing means push the poultry specimens out of the receptor tray. The only manual operation then remaining will be manual positioning of the specimens in the receptor trays.

The invention also relates to an apparatus for practicing the method according to the invention characterized by a packaging line comprising openable and closable clamping jaw means defining the catching means, as well as pushing means having the form of a ram, and suspended from an endless conveyor belt. The lower part of said belt is disposed above and longitudinally of a passage whereby said pushing means can each time push a poultry specimen clamped with the legs in the jaws. In longitudinal direction of this passage there extends an at least partly reciprocable, at least partly funnel-shaped tube, of which the funnel-shaped portion is provided with jaws adapted to be opened and closed to control the pointed configuration of said funnel. The top of said tube is provided with a longitudinal slot through which the linking means connecting the catching and pushing means can move with the conveyor belt, carrying same during the passage of said catching means and pushing means through said tube. In this tube there are disposed steering means and stop or abutting means controlled by said steering means for effecting a temporary stop for the poultry specimen for folding the legs of said specimen. There are first means for opening the bag and second means for keeping the bag open, as well as drive means for reciprocably driving the tube, at least the funnel-shaped portion, and also such retaining means for retaining the bag during the pushing-in of the specimen so that the bag, when a given magnitude of the pushing force is exceeded, is released from the retaining means, at least with the portion containing the filler.

A preferred embodiment of an apparatus according to the invention is characterized by a second conveyor belt which transports a plurality of adjacently disposed receptor trays along a path intersecting the belt for the catching and pushing means. In these trays there are disposed resilient clamping means for resiliently retaining the legs of each specimen introduced. These resilient clamping means comprise a carrier swivelling against the spring force and carrying two fork-shaped clamps having jaws adapted to open against the spring action of the resiliency means of clamping means for retaining the legs of the specimen. Upon the crossing of the catching and pushing means of the path of the leg ends of the specimen maintained in the clamping means of the receptor trays, the leg ends then clamped by the catching means cause the carrier to swivel in the direction of motion of the catching means, thus opening the jaws and releasing the specimen from the tray so that it can be entrained therefrom in longitudinal direction by the catching and/or pushing means.

The apparatus according to the invention can be effectively used for multiple design so that the second belt is conducted along the supply side of a plurality of parallel packaging devices according to the invention jointly accommodated in a frame. For instance it will then be possible by means of automatic signalling and controlling means known per se to automatically supply from said receptor trays each packaging device adjusted to the different sizes of the poultry specimens, said trays containing a specimen of the size or weight in question.

The invention is illustrated by way of example in the accompanying drawings, in which.

Figure 1:
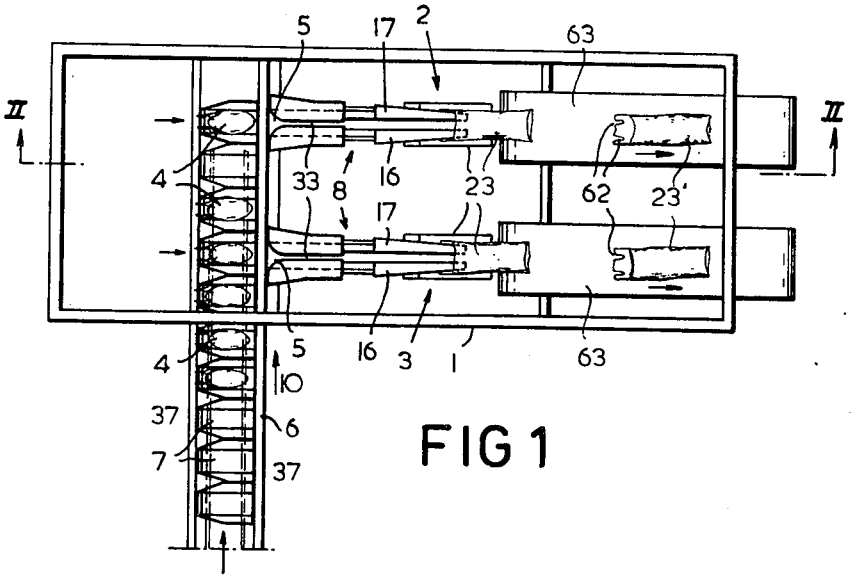
FIG. 1 is a diagrammatic top view of an apparatus according to the invention.

The drawing shows a frame 1 comprising two packaging lines 2 and 3 each of which can perform a complete packaging cycle. The lines 2 and 3 are provided with poultry specimens 4 to be packaged by a supply conveyor belt 6 guiding receptor trays 7 along the advance openings 5 of the lines 2 and 3, said receptor trays 7 having the specimens 4 positioned therein. The lines 2 and 3 are positioned at a mutual pitch distance equal to three times the pitch distance of two adjacent trays 7.

Figure 2:
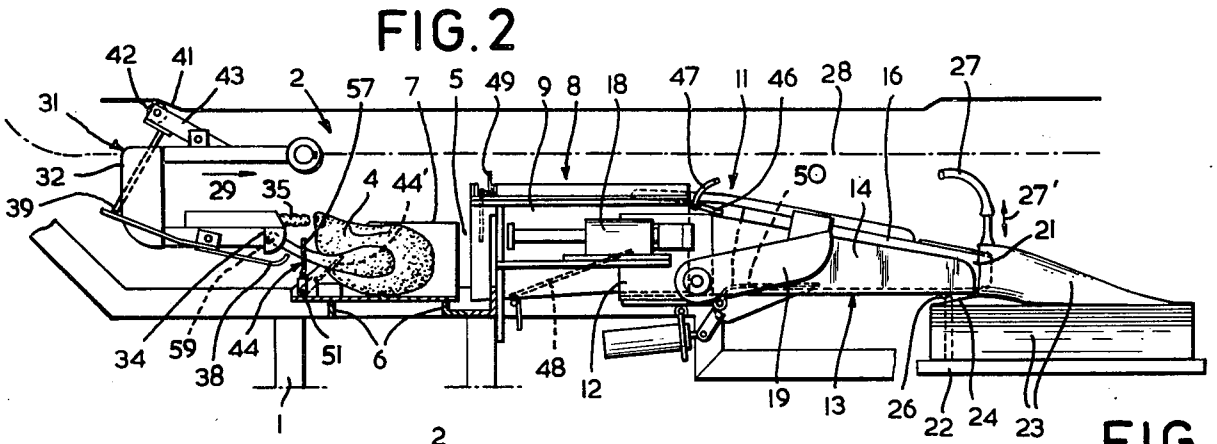
FIG. 2 illustrates on a scale larger than that of FIG. 1 a diagrammatic side view of a packaging line, said view being taken along line II—II of FIG. 1.

FIG. 2 shows on a larger scale than FIG. 1 the packaging line 2 as seen on the line II—II of FIG. 1. A poultry specimen 4 is still in the tray 7. The line 2 comprises a tube 8 which has its advance opening 5 facing the tray 7 of the conveyor belt 6 being just in front of said advance opening 5. The tube 8 has a stationary portion 9 and a funnel-shaped portion 11, comprising channel member 12 translatable horizontally relative to the portion 9 longitudinally of the packaging line, and the funnel 13 proper suspended from said channel member 12. Said funnel 13 is composed of the stationary jaw 14 fixedly connected to the channel member 12, said jaw forming the lower wall and the lower side-walls of the funnel 13 and the upper jaws 16, 17 pivotally connected to the channel member 12.

The stationary portion 9 of the tube 8 is fixedly connected to the frame 1. On either side of the portion 9 there are mounted guiding means 18 carrying the funnel-shaped portion 11 and included with means for driving horizontally translatably via the channel member 12. This channel member 12 is translatably moved by a non-illustrated pneumatic drive controlled by the lever 32 when passing thereby occurs. The upper jaws 16, 17 are pivotally mounted by means of a set of jibs 19 thus obtaining an adjustable height dimension for the funnel opening 21.

On a vertically adjustable table 22 there is provided a stack of bags 23 which are secured with their lower wall 24 to pins 26. Above the stack of bags 23 there is provided a suction nozzle 27 which can be moved mechanically towards and from the upper bag 23, as indicated by arrow 27′ (not further discussed since this mechanism does not form a part of the invention). The nozzle 27 is furthermore connected to a suction pump, not shown for the same reasons. On the portion 9 of the tube 8 there is mounted a blow nozzle 46 which is aligned in longitudinal direction of the funnel-shaped portion 13. The tube 47 is connected to a force pump likewise not shown for the above reasons. The numeral 49 designates a switching strip which, upon operation by the passing poultry body, brings about that air is blown from the blow nozzle 46. In the interior of the stationary portion 9 of tube 8 there is a control means including a switching plate 48 which, upon operation via a pneumatic drive, not shown, controls means including the tilting baffle 50 pivotal in the stationary jaw 14.

Above the passage occupied by the tube 8 there moves the lower portion of a conveyor chain 28 which in the direction of the arrow 29 conveys a plurality of carriers 31, one of which is shown. The narrow lever 32 passes through a slot 33 of tube 8 (see FIG. 1). The carrier 32 carries a ram 34 adapted to push against the legs of the poultry body 4 disposed in the tray 7. The ram 34 carries furthermore, a resilient support finger 35 supporting the packaged entrails present in the abdominal cavity of the bird. Furthermore, there is pivotally suspended from the carrier 31 a clamping leg 38 which, via a pin 39 conducted through the lever 32, is operated by coaction of a cam 41, a cam roller 42 and a lever 43. The cam 41 is fixedly mounted relative to the frame 1.

Figure 4:
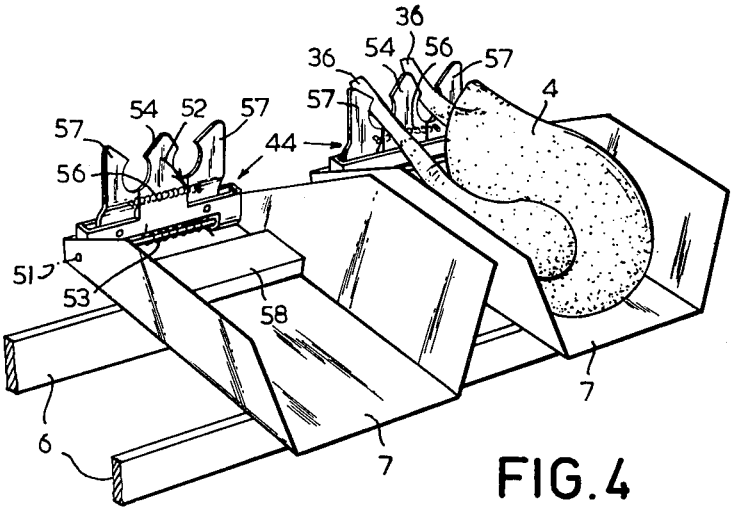
FIG. 4 is an isometric view of a part of the supply conveyor belt with receptor trays on a larger scale than that of FIG. 2.
Figure 3:
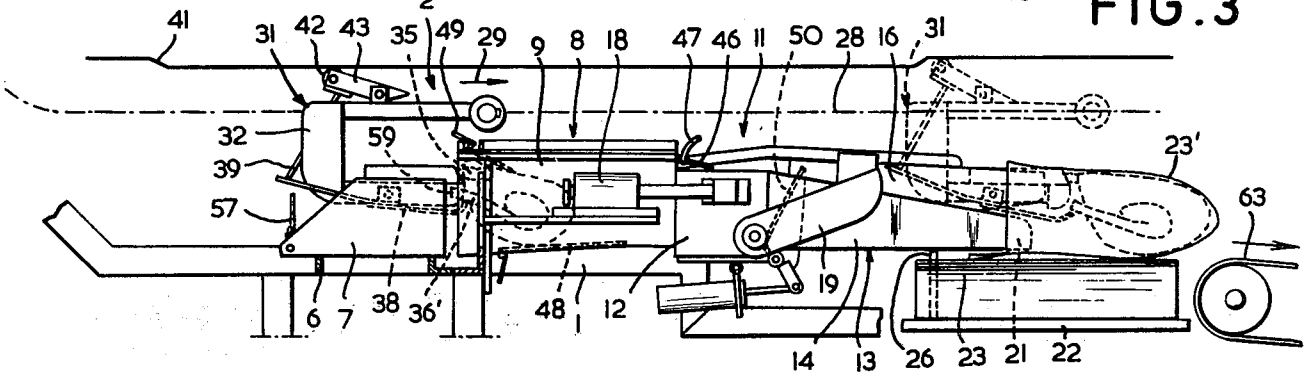
FIG. 3 is a diagrammatic side view as FIG. 2 but showing the mechanism in a different position of operation.
Figure 5:
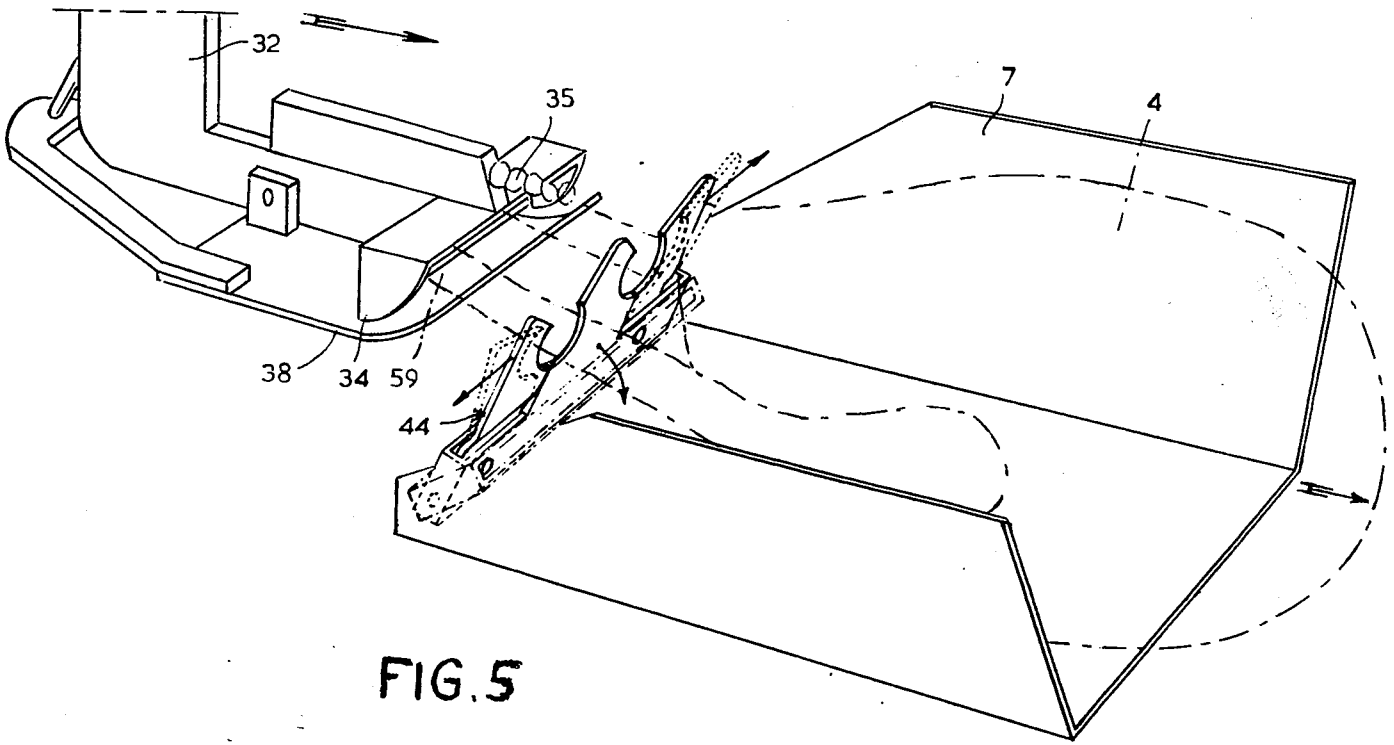
FIG. 5 is an enlarged isometric view showing the face of the ram and other details.

The receptor tray 7 contains a clamping member 44 (FIGS. 2, 3, 4) which can swivel in its entirety about the pivot line 51, as shown by arrow 52, the spiral spring 53 urging the clamping member 44 in upright positions against a stop, not shown. The clamping member 44 furthermore comprises stationary jaws 54, and, through application of a draw spring 56, two spring-loaded movable jaws 57. FIG. 4 shows a poultry specimen 4 in a receptor tray 7 with the legs 36 being clamped between the jaws 54 and 57. A support beam 58 serves for supporting the two legs 36 and to prevent the bird body 4 from oblique positioning.

The operation of the above described apparatus is as follows: The conveyor belt 6 (FIG. 1) runs intermittently with a range of motion of each time the pitch distance of two receptor trays 7, in the direction of arrow 10. At 37 poultry specimens 4 can continuously be positioned in the trays 7. This can be effectively done by hand. The insertion is effected in such a way (see FIG. 4) that the legs 36 snap slightly above the ankles 59, forming the thickened ends of the legs 36, between the resilient jaws 57 and the stationary jaws 54 of the clamping member 44. Furthermore the legs 36 bear on the support beam 58 to ensure the straight position of the bird.

Upon the periodic stops of the conveyor belt 6 each time two trays 7 with their poultry specimen 4 are present at the head end 5 of the packaging lines 2, 3, (see FIGS. 2 and 3) in which the packaging line 3 is shown in side view, respectively in two positions of the packaging cycle. FIG. 2 shows the position wherein the ram 34 has approached the then stationary tray 7, and commences to push against the ankles 59 of the bird body 4. At or about that moment the clamping leg 38 initiates a closing movement because the cam roller 42 runs against the cam 41 so that the lever 43 swivels downwardly, which movement is transmitted through pin 39 into the clamping leg 38. The ends 59 of the legs 36 are now clamped between the ram 34 and the clamping leg 38. Thus the poultry specimen 4 is entrained in the continuous movement of the carrier 31 and pushed out of the receptor tray 7, during which the following occurs. Upon the pushing away of the poultry specimen 4 the clamping member 44 tilts towards the position 44′ shown in FIG. 2 by dotted lines. In this inclined position the legs 36 open the jaws 57, whereafter the bird body 4 is released from the clamping member 44, which thereafter springs back to its vertical position.

The specimen 4 is then pushed into the tube 8, in the portion thereof. The bird 4 operates the switching strip 49, thus activating the suction nozzle 27 and the blow nozzle 46, thereby placing the topmost bag 23 in the position as shown in FIG. 2. Subsequently, the poultry specimen 4 abuts the switching plate 48 so that the tilting baffle 50 arrives in the position shown in FIG. 3, which upright baffle 50 is going to arrest the arriving body of the bird 4. This results in the folding of the legs 36 (see the position 36′ of the bird with the legs 36 in FIG. 3). Once the legs 36 being folded, the ram 34 commences to urge against the bird with increasing force through the continuing movement of the carrier 31. Because now the tilting baffle 50 is kept in upright position by a pneumatic counter-pressure set at a specific maximal value, the baffle 50 yields at a given moment. In the pneumatic circuit, not shown, for the control of said baffle 50, this leads by means of conventional switching and control means which do not form a part of the invention, to a sudden reversal of the pressure in the pneumatic jack concerned, so that the tilting baffle 50 is rapidly collapsed and comes to lie flat against the bottom of the tube portion 9 (FIG. 2). The poultry specimen 4 can now continue its way. Now by the powering of the revelent pneumatic drive, not shown, initiated by the level 32, the channel member 12 moves to the right, bringing the funnel-shaped portion 11 into the bag 23. Meanwhile, the following has taken place relative to the funnel portion 13. After the bag 23 has been opened by the suction and blow means 27 and 46, 47, and the channel member 12 with the funnel-shaped portion 13 moving to the right (see FIG. 3) with regard to FIG. 2, whereby the opening 21 enters the opening of the bag 23, the jaws 16, 17, swivel upwards so that the bag 23 is opened wider. Meanwhile, the bird body 4 moves through the funnel 13, further into the bag 23. The bag 23 is retained in that the lower wall 24 thereof with the holes 62 are secured on the fixed pins 26. However, the bags 23 are made of tearable material, e.g. polythene, the dimensions being so chosen that at a specific force, the holes 62 will be torn. Consequently, when the bird body 4 is pressed with force as far as the bottom of the bag 23, the bag 23 will first be stretched while tensioning the holes 62. Finally the holes 62 will be torn, however, and the bag portion 23' containing the filler can be freely entrained, whereafter it then arrives on a discharge conveyor belt 63, so that further treatment falling beyond the scope of the invention, can take place.

After the bag portion 23' has been loosened, the table 22 is accurately lifted over the thickness of a bag for the next packaging cycle. The pins 26 remain in position. It is observed yet on the switching strip 49 and the switching plate 48 that their application prevents that, when for some reason there appears an empty receptor tray 7 before the packaging line 2, 3 and the carrier 31 consequently passes through the tube 8 without bird, the switching strip 49 and the switching plate 48 are not touched so that the blow and suction means 27, 46 remain inactive and the topmost bag is not opened respectively the baffle plate 50 is not actuated to the upright position.

It is, of course, to be understood that the present invention is, by no means, limited to the specific showing in the drawings but also comprises any modifications within the scope of the appended claims.

What I claim is:

1. A method for packaging specimens of prepared poultry in bags, so that each specimen eventually will be positioned in a bag with the legs folded and lying against the bottom side of the body, whereafter the bag with contents is discharged for further treatment, comprising the steps of catching each specimen to be packaged at the legs by means of catching means advanced by a conveyor belt, through pushing means acting on the legs producing an upward pushing motion in the direction of the poultry body, then by a translation, through said upward pushing in the same direction moving the specimen across an articulated funnel provided with abutting means, stopping temporarily the specimen at the abutting means while the translative movement of the legs of the specimen continues, involving and folding the legs of the specimen firmly against the bottom side of the body of the specimen, after which there is withdrawing of the abutting means when the pressure exerted by the body of the specimen on the abutting means exceeds a certain value of the resisting force of the abutting means and pushing the specimen with folded legs to proceed further with the pushing means, said funnel having jaws movable relative to each other, inserting jaws in converged condition in a bag kept stationary by retaining means, thereafter moving the jaws outwardly relative to each other so that the poultry specimen can leave the funnel via the jaws and arrive in the bag enveloping the funnel, thereafter retracting the funnel and advancing the bag with the poultry specimen contained therein by the pushing means, and through coaction of the pushing means and the retaining means of the bag releasing at least the filled bag portion from the retaining means.

2. A method according to claim 1, comprising added steps of supplying the poultry specimens to the catching means by means of a conveyor belt whose path intersects the catching means perpendicularly, on which belt there are disposed in adjacent relationship receptor trays, positioning in the trays poultry specimens one after the other, holding each leg in a resiliently tiltable spring loaded clamp which can be opened against the action of the spring loading force working on the clamp when the catching means after having engaged the legs, tilts the clamp in the direction of the progress of the same catching means, and by way of the pushing means pushing the poultry specimen further out of the tray.

3. An apparatus for packaging specimens of prepared poultry in bags so that each specimen eventually will be positioned in a bag with the legs folded and lying against the bottom side of the body in a packaging line including a catching means for clamping the legs of each specimen comprising openable and closable clamping jaws means constituting the catching means, as well as ram-shaped pushing means suspended from an endless conveyor belt, the lower part of said belt being disposed above and longitudinally of a passage, through which said ram-shaped pushing means can each time push a poultry specimen clamped with the legs in the clamping jaws, an at least partly reciprocable, at least partly funnel-shaped tube extending longitudinally of the passage and having a funnel-shaped portion provided with openable and closable jaws, said tube having a longitudinal slot at the top side thereof, linking means connecting the catching means and the pushing means to move with the conveyor belt carrying same during the passage of said catching means and the pushing means through the tube, control means disposed in said tube for controlling abutting means for effecting a temporary stop for obstructing the passage of the body of the specimen when said control means are engaged by a passing body while the conveyor belt moves on thus folding the legs of the specimen against the body of the specimen and first means for opening the jaws of the funnel-shaped tube for opening the bag and second means for keeping open the bag, and means for reciprocably driving the tube including at least the funnel-shaped portion for driving the funnel-shaped tube into the bag, and retaining means for retaining the bag during insertion of the specimen relative to the bag so that in response to a given magnitude of the pushing force being exceeded there occurs release thereof from the retaining means permitted at least with respect to the filled portion thereof.

4. An apparatus according to claim 3 wherein a second conveyor belt is provided for transporting a plurality of adjacently disposed receptor trays along a path intersecting the belt for the catching means, and the pushing means, resilient clamping means disposed in the trays and having resiliency means therewith for resiliently retaining the legs of each specimen introduced, said resilient clamping means comprising a carrier swivelling against the force of the resiliency means of clamping means, said carrier carrying two fork-shaped clamps having jaws openable against the spring action for retaining the legs of the specimen in such a way that upon the intersection of the catching means and the pushing means of the path of the leg there are ends of the specimen retained in the clamping means of the trays, the leg ends when clamped by the catching means causing the carrier to swivel in the direction of motion of the catching means thus enabling the legs to push open the jaws so that the specimen is released from the tray and can be entrained therefrom in longitudinal direction by the catching and/or pushing means.

5. An apparatus according to claim 4, characterized in that there are disposed therewith at least two packaging lines that can be operated by one supply conveyor belt having receptor trays.

* * * * *